US009672682B2

(12) United States Patent
Kitamura et al.

(10) Patent No.: US 9,672,682 B2
(45) Date of Patent: Jun. 6, 2017

(54) PRESENTATION EFFECT DEVICE FOR USE IN GAMING MACHINE AND GAMING MACHINE

(71) Applicants: Universal Entertainment Corporation, Tokyo (JP); Aruze Gaming America, Inc., Las Vegas, NV (US)

(72) Inventors: Kenta Kitamura, Tokyo (JP); Kou Kobayashi, Tokyo (JP); Takashi Izawa, Tokyo (JP); Masumi Sakamoto, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 112 days.

(21) Appl. No.: 14/256,050

(22) Filed: Apr. 18, 2014

(65) Prior Publication Data

US 2014/0342800 A1 Nov. 20, 2014

(30) Foreign Application Priority Data

May 17, 2013 (JP) ..... 2013-105341

(51) Int. Cl.
*G07F 17/32* (2006.01)

(52) U.S. Cl.
CPC ..... *G07F 17/3213* (2013.01)

(58) Field of Classification Search
CPC ..... G07F 17/3211; G07F 17/3213
USPC ..... 463/20
See application file for complete search history.

(56) References Cited

U.S. PATENT DOCUMENTS 2,545,675 A * 3/1951 Scott ..... G03B 21/001 359/448
6,292,314 B1 * 9/2001 Perger ..... G02B 23/10 359/638
6,517,437 B1 * 2/2003 Wells ..... G07F 17/3211 273/143 R
7,397,461 B1 * 7/2008 Graham ..... G06F 1/20 345/156
7,884,814 B1 * 2/2011 Graham ..... G06F 1/1609 345/204
8,715,079 B1 * 5/2014 Loose ..... G07F 17/3211 463/30
2004/0266536 A1 * 12/2004 Mattice ..... G07F 17/3202 463/43
2005/0037843 A1 * 2/2005 Wells ..... G07F 17/3211 463/30

(Continued)

*Primary Examiner* — Jason Skaarup
(74) *Attorney, Agent, or Firm* — Lex IP Meister, PLLC

(57) ABSTRACT

Provided is a presentation effect device capable of providing a new presentation effect in which it is possible to change the state where a player can visibly recognize an object to be visibly recognized to the state where a player can visibly recognize the object without any movable member. A presentation effect device is provided with a plate-like panel, an accommodation space partitioned by the plate-like panel, the accommodation space for accommodating an object to be visibly recognized, and an illumination device for illuminating the object to be visibly recognized by a signal from the outside, wherein the plate-like panel is composed of a beam splitter for dividing incoming light into reflection light and transmitted light.

5 Claims, 9 Drawing Sheets

(56) References Cited

U.S. PATENT DOCUMENTS

| | | | | |
|---|---|---|---|---|
| 2006/0100014 | A1* | 5/2006 | Griswold | G07F 17/3202 463/31 |
| 2009/0131145 | A1* | 5/2009 | Aoki | G07F 17/3211 463/20 |
| 2011/0117998 | A1 | 5/2011 | Hirato | |
| 2016/0054966 | A1* | 2/2016 | Dinning | G07F 17/3211 463/17 |

* cited by examiner

PRESENTATION EFFECT DEVICE FOR USE IN GAMING MACHINE AND GAMING MACHINE

CROSS-REFERENCE TO RELATED APPLICATIONS

This application is based on and claims a priority from the prior Japanese Patent Application No. 2013-105341 filed on May 17, 2013, the entire contents of which are incorporated herein by reference.

BACKGROUND OF THE INVENTION

1. Field of the Invention

The present invention relates to a presentation effect device for use in a gaming machine, and more specifically to a presentation effect device which is provided as a top box of a gaming machine to carry out a presentation effect using emission of light.

2. Background of the Related Art

Conventionally, various effects have been provided in accordance with the progress of a game. The presentation effects includes those using sound, moving images, moving objects such as a doll, as well as light. The presentation effect using light has been carries out by providing various lamps in a housing of the gaming machine so as to light extinguish or blink the lamps with various colors light in accordance with the progress of the game.

For example, the applicant has offered a gaming machine having a top box device with which characters and a movable window are provided. The characters are a little pig living in a straw house, a little pig living in a wooden house and a little pig living in a brick house. The movable window is provided in each of the straw house, the wooden house and the brick house. Each window is structured to be openable and closable.

In this gaming machine, the game progresses so that it is possible to win a prize corresponding to any of the little pig living in a straw house, the little pig living in a wooden house or the little pig living in a brick house described above.

Then, when winning a prize in relation to "the little pig living in a straw house", a player can visibly recognize "the little pig living in a straw house" through the window of the straw opened resultingly. Likewise, the window of the wooden house is opened upon winning a prize in relation to "the little pig living in a wooden house", and the window of the brick house is opened upon winning a prize in relation to "the little pig living in a brick house". On the other hand, when the character-winning game is not played or a prize in relation to the character cannot be acquired, the window is in the closed state so that little pigs cannot be visible recognized.

In this manner, a player can visibly recognize the character, the little pigs, when the window is opened, while a player cannot visibly recognize the character when the window is closed.

As described above, the conventional top box device for the gaming machine has been known which carries out the presentation effect capable of changing from the state where it is possible to visibly recognize the character, the little pigs, to the state where it is impossible to visibly recognize the character by opening and closing the window (for example, refer to Publication of US Patent Application No. 2011/117998).

As described above, the conventional gaming machine has changed from the state where it is possible to visibly recognize the character as an object to be visibly recognized to the state where it is difficult to visibly recognize the object by physically opening and closing a window. In this manner, the presentation effect in which a window in front of a character is opened and closed so that the character formed as an object to be visibly recognized can be visibly recognized by a player in accordance with a won prize is effective as a presentation effect display.

SUMMARY OF THE INVENTION

However, the window is operated to be opened and close using various movable members such as solenoid or interacting members. Therefore, increase in such members raises the possibility of causing a malfunction.

Then, in the case where the malfunction occurs, it must be necessary to do the operation such as repair or replacement, prepare repairing parts, and spend a maintenance cost.

The present invention provides a gaming machine using a presentation effect device capable of providing a new presentation effect in which it is possible to change from the state where a player can visibly recognize an object to be visibly recognized to the state where a player cannot visibly recognize an object in accordance with the progress of a game without any operation member, and a gaming machine using the presentation effect device.

An embodiment of a presentation effect device according to the present invention is that it is provided:

a plate-like panel;

an accommodation space partitioned by the plate-like panel, the accommodation space for accommodating an object to be visibly recognized; and an illumination device for illuminating the object to be visibly recognized by a signal from the outside, wherein:

the plate-like panel is composed of a beam splitter for dividing incoming light into reflection light and transmitted light.

As described above, in the state where illumination of a illumination device is extinguished, it is difficult to visibly recognize the object to be visibly recognized because of the interference due to light generated by reflecting light outside the presentation effect device by a beam splitter. On the other hand, in the state where illumination of a illumination device is lighted, it becomes easy to visibly recognize the object to be visibly recognized because light from the inside of the presentation effect device passing through the beam splitter increases to act against the light generated by reflecting light outside the presentation effect device Furthermore, the embodiment of the presentation effect device according to the present invention is that the object to be visibly recognized is provided on the upper side from a display for displaying a plurality of rearranged symbols.

The presentation effect device is arranged at the position where eyes of a player look upward when the player takes an attitude of playing a game on the gaming machine. The arrangement makes the object to be visibly recognized inside of an accommodation space possible to be more difficult to be visibly recognized by the player when the object to be visibly recognized is not illuminated by the illumination device, compared to the case where the player looks in the direction perpendicular to the beam splitter.

For example, the object to be visibly recognized may be visibly recognized slightly depending on the intensity of illumination in a facility even if the illumination of the illumination device is turned off. However, the player visibly recognizes the object to be visibly recognized with line of sight so as to look up at a plate-like beam splitter, namely, an acute angle is made between a plate-like panel surface of the beam splitter and the line of sight of the player. Therefore, it is possible to be more difficult to visibly recognize the object to be visibly recognized when the object to be visibly recognized is not illuminated by the illumination device, the object to be visibly recognized can become difficult to be visibly recognized.

Furthermore, the embodiment of the presentation effect device according to the present invention is that the plate-like panel structured by the beam splitter is arranged so that a surface of the plate-like panel is arranged to be inclined in an upward direction.

A more acute angle can be made between line of sight of a player directed to the object to be visibly recognized which is provided in the accommodation space and the plate-like panel. Furthermore, the object to be visibly recognized can become difficult to be visibly recognized.

Furthermore, the embodiment of the presentation effect device according to the present invention is that the beam splitter is set so that reflectivity exceeds transmittance when an angle of incidence of light to be entered is 45°.

The case where the reflectivity is equal to the transmittance is a so-called half mirror, whereas the case where the reflectivity is higher than the transmittance is a so-called magic minor. Both the half mirror and the can be employed as a beam splitter. This makes it possible to further clarify the state where the object to be visibly recognized can be visibly recognized and the state where the object cannot be recognized.

An embodiment of a gaming machine according to the present invention is that it is provided:

a presentation effect device, comprising a plate-like panel, an accommodation space partitioned by the plate-like panel, the accommodation space for accommodating an object to be visibly recognized, and an illumination device for illuminating the object to be visibly recognized by a control signal, wherein the plate-like panel is composed of a beam splitter for dividing incoming light into reflection light and transmitted light;

a display in which symbols are rearranged; and a controller for controlling a game of the rearrangement of the symbols, and for transmitting the control signal based on the state of the game.

As described above, in the state where illumination of a illumination device is extinguished, it is difficult to visibly recognize the object to be visibly recognized because of the interference due to light generated by reflecting light outside the presentation effect device by a beam splitter. On the other hand, in the state where illumination of a illumination device is lighted, it becomes easy to visibly recognize the object to be visibly recognized because light from the inside of the presentation effect device passing through the beam splitter increases to act against the light generated by reflecting light outside the presentation effect device Furthermore, the embodiment of the gaming machine according to the present invention is that the object to be visibly recognized is provided on the upper side from a display for displaying a plurality of rearranged symbols.

The presentation effect device of the gaming machine according to the present invention is arranged at the position where eyes of a player look upward when the player takes an attitude of playing a game on the gaming machine. The arrangement makes the object to be visibly recognized inside of an accommodation space possible to be more difficult to be visibly recognized by the player when the object to be visibly recognized is not illuminated by the illumination device, compared to the case where the player looks in the direction perpendicular to the beam splitter.

For example, the object to be visibly recognized may be visibly recognized slightly depending on the intensity of illumination in a facility even if the illumination of the illumination device is turned off. However, the player visibly recognizes the object to be visibly recognized with line of sight so as to look up at a plate-like beam splitter, namely, an acute angle is made between a plate-like panel surface of the beam splitter and the line of sight of the player. Therefore, it is possible to be more difficult to visibly recognize the object to be visibly recognized when the object to be visibly recognized is not illuminated by the illumination device, the object to be visibly recognized can become difficult to be visibly recognized.

Furthermore, the embodiment of the gaming machine according to the present invention is that the plate-like panel structured by the beam splitter is arranged so that a surface of the plate-like panel is arranged to be inclined in an upward direction.

A more acute angle can be made between line of sight of a player directed to the object to be visibly recognized which is provided in the accommodation space and the plate-like panel. Furthermore, the object to be visibly recognized can become difficult to be visibly recognized.

Furthermore, an embodiment of the gaming machine according to the present invention is that it is provided:

a presentation effect device comprising an accommodation body defined by a plate-like panel to accommodate an object to be visibly recognized, and an illumination device for illuminating the object to be visibly recognized in response to a control signal;

a display in which symbols are rearranged; and a controller for controlling a game of the rearrangement of the symbols, and for transmitting the control signal based on the state of the game, wherein:

the plate-like panel has a beam splitter dividing light entering into the plate-like panel into incoming light and transmitted light;

the beam splitter has a first range of angle including transmittance depending on an angle of incoming light to be the predetermined transmittance, and a second range of angle including transmittance lower than that of the first range of angle;

the first range of angle is smaller than the predetermined angle of incidence, and the second range of angle is larger than the predetermined angle of incidence;

the object to be visibly recognized is provided on the upper side from the display;

an image of the object to be visibly recognized illuminated by the illumination device is passed through the second range of angle toward the front of the display upon the illumination device illuminating the object to be visibly recognized in response to the control signal.

The object to be visibly recognized on the upper side from the display, and a player is located in front of the display. Furthermore, the image of the object to be visibly recognized illuminated by the illumination device is directed to the front of the display through the second range of angle. Therefore, when the player located in front of the display turns his/her eyes upward, the line of sight of the player's eyes is directed to the object to be visibly recognized through the second range of angle.

In the state where the illumination device is extinguished, the object to be visibly recognized accommodated in the accommodation body is illuminated only by weak light from the outside of the accommodation body. Therefore, the light illuminating the object to be visibly recognized is not easily to be transmitted with the second range of angle having low transmittance, so that it becomes difficult for the player to visibly recognize the image of the object to be visibly recognized even if the player turns his/her eyes to the object to be visibly recognized. On the other hand, in the state where the illumination device is lighted, the object to be visibly recognized accommodated in the accommodation body is illuminated by strong light from the illumination device. Therefore, the light illuminating the object to be visibly recognized can be transmitted even with the second range of angle having low transmittance, so that it becomes easy for the player to visibly recognize the image of the object to be visibly recognized when the player turns his/her eyes to the object to be visibly recognized.

Furthermore, the embodiment of the gaming machine according to the present invention is that:

upon lighting the illumination device in response to the control signal, light emitted from the illumination device is reflected in the inside of the accommodation body to illuminate the object to be visibly recognized, and the light illuminated the object to be visibly recognized is transmitted toward the front of the display through the second range of angle.

When entering into the plate-like panel with the second range of angle, the light emitted from the illumination device is easily reflected by the plate-like panel. Therefore, it is possible to uniformly illuminate the object to be visibly recognized by repeatedly performing the reflection within the accommodation body. Furthermore, when the illumination device is lighted, strong light is emitted from the illumination device. Therefore, much amount of light entered into the plate-like panel with the second range of angle is reflected by the plate-like panel, whereas the light passing through the plate-like panel also increases in accordance with the intensity. Therefore, the light illuminating the object to be visibly recognized can be transmitted even with the second range of angle, so that the player can visibly recognize the image of the object to be visibly recognized.

Furthermore, the embodiment of the gaming machine according to the present invention is that:

the presentation effect device is provided on the upper side of the gaming machine;

the plate-like panel has a front face panel arranged on the front side of the gaming machine; and the front face panel is arranged to be raised with increasing distance from the front side of the gaming machine.

The second range of angle is larger than the predetermined angle of incidence. Therefore, the front panel of the presentation effect device is arranged to be gradually raised with increasing distance from the front side of the gaming machine, so that the second range of angle can be directed toward the player, and also the line of sight of the player can be included within the second range of angle upon the player turning his/her eyes upward toward the object to be visibly recognized.

It can be provide a new presentation effect capable of changing the state where a player can visibly recognize an object to be visibly recognized to the state where a player can visibly recognize the object without any movable member.

DESCRIPTION OF PREFERRED EMBODIMENTS

Embodiments will be described below based on the drawings.

<<<Overview of a Gaming Machine 10>>>

Figure 1:
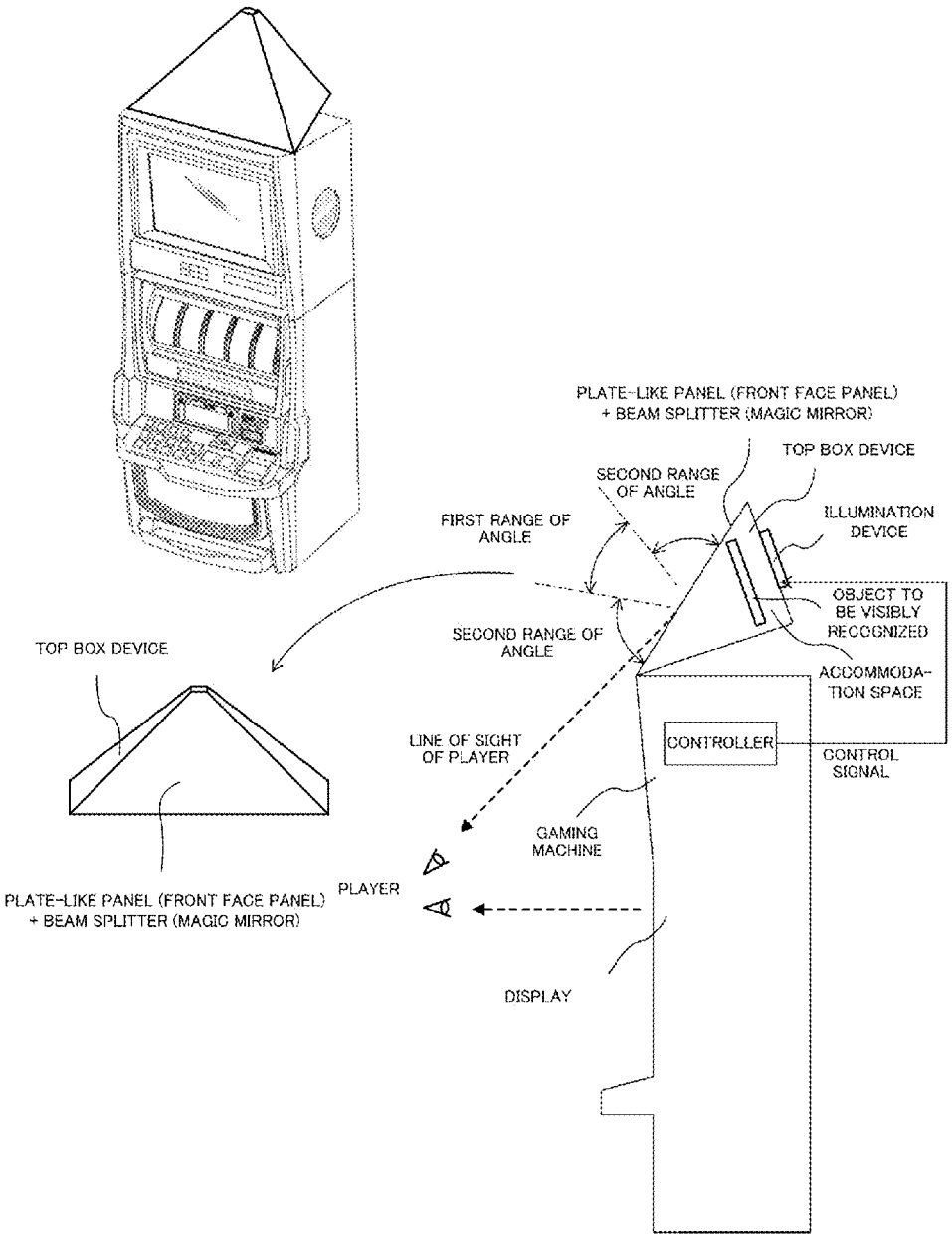
FIG. 1 is a schematic diagram showing a presentation effect device for use in a gaming machine according to the present embodiment.

FIG. 1 is a diagram schematically showing a presentation effect device according to the present embodiment.

A presentation effect device according to the present embodiment (such as a presentation effect device 300 described below) is composed of:

a plate-like panel (a front face panel 310);

an accommodation space (such as an internal space S described below) partitioned by the plate-like panel, the accommodation space for accommodating an object to be visibly recognized (such as an object to be recognized 340, 342 described below); and an illumination device (such as a light source 352 described below) for illuminating the object to be visibly recognized by a signal from the outside, wherein:

the plate-like panel is composed of a beam splitter (such as a beam splitter 320 described below) for dividing incoming light into reflection light and transmitted light.

The presentation effect device according to the present embodiment is provided with a plate-like panel, an accommodation space, and an illumination device. The plate-like panel preferably has translucency.

The accommodation space is defined by being partitioned by the plate-like panel. The accommodation space is a space for accommodating an object to be visibly recognized.

The illumination device is controlled by a signal from the outside. The signal from the outside is preferably output from a controller of the gaming machine. It is possible to provide a presentation effect in accordance with the progress of a game in the gaming machine. The illumination device illuminates the object to be visibly recognized. For example, the signal from the outside controls lighting, extinguishing and brink, as well as color and intensity of light to be transmitted.

The plate-like panel is composed of a beam splitter. The beam splitter reflects a part of light entered thereinto and passes it therethrough, so as to divide the entered light into reflected light and transmitted light. The beam splitter has appropriate transmittance and reflectivity.

As described above, in the state where illumination of a illumination device is extinguished, it is difficult to visibly recognize the object to be visibly recognized because of the interference due to light generated by reflecting light outside the presentation effect device by a beam splitter. On the other hand, in the state where illumination of a illumination device is lighted, it becomes easy to visibly recognize the object to be visibly recognized because light from the inside of the presentation effect device passing through the beam splitter increases to act against the light generated by reflecting light outside the presentation effect device.

Furthermore, in the presentation effect device according to the present embodiment, the object to be visibly recognized is provided on the upper side from a display (such as a display window 150 described below) for displaying a plurality of rearranged symbols.

The presentation effect device is arranged at the position where eyes of a player look upward when the player takes an attitude of playing a game on the gaming machine. The arrangement makes the object to be visibly recognized inside of an accommodation space possible to be more difficult to be visibly recognized by the player when the object to be visibly recognized is not illuminated by the illumination device, compared to the case where the player looks in the direction perpendicular to the beam splitter.

For example, the object to be visibly recognized may be visibly recognized slightly depending on the intensity of illumination in a facility even if the illumination of the illumination device is turned off. However, the player visibly recognizes the object to be visibly recognized with line of sight so as to look up at a plate-like beam splitter, namely, an acute angle is made between a plate-like panel surface of the beam splitter and the line of sight of the player. Therefore, it is possible to be more difficult to visibly recognize the object to be visibly recognized when the object to be visibly recognized is not illuminated by the illumination device, the object to be visibly recognized can become difficult to be visibly recognized.

Furthermore, in the presentation effect device according to the present embodiment, the plate-like panel structured by the beam splitter is arranged so that a surface of the plate-like panel is arranged to be inclined in an upward direction.

A more acute angle or an angle closer to an acute angle can be made between line of sight of a player directed to the object to be visibly recognized which is provided in the accommodation space and the plate-like panel. Furthermore, the object to be visibly recognized can become difficult to be visibly recognized.

Furthermore, in the presentation effect device according to the present embodiment, the beam splitter is set so that reflectivity exceeds transmittance when an angle of incidence of light to be entered is 45°.

The case where the reflectivity is equal to the transmittance is a so-called half mirror, whereas the case where the reflectivity is higher than the transmittance is a so-called magic mirror. Both the half mirror and the magic minor can be employed as a beam splitter. This makes it possible to further clarify the state where the object to be visibly recognized can be visibly recognized and the state where the object cannot be recognized.

A gaming machine (such as a gaming machine 10 described below) according to the present embodiment is provided with:

a presentation effect device, comprising a plate-like panel (a front panel 310), an accommodation space (such as an internal space S described below) partitioned by the plate-like panel, the accommodation space for accommodating an object to be visibly recognized (such as an object to be recognized 340, 342 described below), and an illumination device (such as a light source 352 described below) for illuminating the object to be visibly recognized by a control signal, wherein the plate-like panel is composed of a beam splitter (such as a beam splitter 320 described below) for dividing incoming light into reflection light and transmitted light;

a display (such as a display window 150 described below) in which symbols are rearranged; and a controller (such as a controller 50 described below) for controlling a game of the rearrangement of the symbols, and for transmitting the control signal based on the state of the game.

As described above, in the state where illumination of a illumination device is extinguished, it is difficult to visibly recognize the object to be visibly recognized because of the interference due to light generated by reflecting light outside the presentation effect device by a beam splitter. On the other hand, in the state where illumination of a illumination device is lighted, it becomes easy to visibly recognize the object to be visibly recognized because light from the inside of the presentation effect device passing through the beam splitter increases to act against the light generated by reflecting light outside the presentation effect device.

Furthermore, in the gaming machine according to the present invention, the object to be visibly recognized is provided on the upper side from a display for displaying a plurality of rearranged symbols.

The presentation effect device of the gaming machine according to the present invention is arranged at the position where eyes of a player look upward when the player takes an attitude of playing a game on the gaming machine. The arrangement makes the object to be visibly recognized inside of an accommodation space possible to be more difficult to be visibly recognized by the player when the object to be visibly recognized is not illuminated by the illumination device, compared to the case where the player looks in the direction perpendicular to the beam splitter.

For example, the object to be visibly recognized may be visibly recognized slightly depending on the intensity of illumination in a facility even if the illumination of the illumination device is turned off. However, the player visibly recognizes the object to be visibly recognized with line of sight so as to look up at a plate-like beam splitter, namely, an acute angle is made between a plate-like panel surface of the beam splitter and the line of sight of the player. Therefore, it is possible to be more difficult to visibly recognize the object to be visibly recognized when the object to be visibly recognized is not illuminated by the illumination device, the object to be visibly recognized can become difficult to be visibly recognized.

Furthermore, in the gaming machine according to the present invention, wherein the plate-like panel structured by the beam splitter is arranged so that a surface of the plate-like panel is arranged to be inclined in an upward direction.

A more acute angle can be made between line of sight of a player directed to the object to be visibly recognized which is provided in the accommodation space and the plate-like panel. Furthermore, the object to be visibly recognized can become difficult to be visibly recognized.

Furthermore, the gaming machine according to the present embodiment is provided with:

a presentation effect device (such as a presentation effect device 300 described below) comprising an accommodation body (such as an internal space S described below) defined by a plate-like panel (such as a front face panel 310 described below) to accommodate an object to be visibly recognized (such as objects to be visibly recognized 340 and 342), and an illumination device (such as a light source 352 described below) for illuminating the object to be visibly recognized in response to a control signal;

a display (such as a display window 150 described below) in which symbols are rearranged; and a controller (such as a controller 50 described below) for controlling a game of the rearrangement of the symbols, and for transmitting the control signal based on the state of the game, wherein:

the plate-like panel has a beam splitter (such as a beam splitter 320 described below) dividing light entering into the plate-like panel into incoming light and transmitted light;

the beam splitter has a first range of angle including transmittance depending on an angle of incoming light to be the predetermined transmittance, and a second range of angle including transmittance lower than that of the first range of angle;

the first range of angle is smaller than the predetermined angle of incidence, and the second range of angle is larger than the predetermined angle of incidence;

the object to be visibly recognized is provided on the upper side from the display;

an image of the object to be visibly recognized illuminated by the illumination device is passed through the second range of angle toward the front of the display (such as an arrow B described below) upon the illumination device illuminating the object to be visibly recognized in response to the control signal.

The object to be visibly recognized which is accommodated in the accommodation body defined by the plate-like panel is provided on the upper side from the display, and the player is located in front of the display. When the player located in front of the display turns his/her eyes upward, the line of sight of the player is directed to the object to be visibly recognized through the plate-like panel. In this case, the direction of the line of sight of the player is included in the second range of angle of the beam splitter of the plate-like panel.

Furthermore, the light from the illumination device illuminating the object to be visibly recognized is reflected by the object to be visibly recognized to be directed to the plate-like panel. The light directed to the plate-like panel includes both light directed to the first range of angle and light directed to the second range of angle. the light reflected by the object to be visibly recognized can reach the player by traveling toward the second range of angle and also passing through the plate-like panel. The image of the object to be visibly recognized is formed in the player's eyes, and thus the player can visibly recognize the object to be visibly recognized.

The object to be visibly recognized may be illuminated by light from the outside of the accommodation body (such as light from the illumination device of the gaming facility) even in the state the illumination device is extinguished. For example, if the direction of light from the outside is included in the first range of angle having high transmittance, the light from the outside can pass through the plate-like panel to enter into the inside of the accommodation body, thereby illuminating the object to be visibly recognized. The light illuminating the object to be visibly recognized is reflected by the object to be visibly recognized to be directed to the plate-like panel. The light included in the second range of angle having low transmittance in the light directed to the plate-like panel is difficult to be passed through the plate-like panel. Therefore, in the case where the illumination device is extinguished, the light illuminating the object to be recognized by the light from the outside may be difficult to reach the player depending on the intensity of light from the outside. The situation may arise in which it becomes difficult for the player to visibly recognize the object to be visibly recognized even if the player turns his/her eyes to the object to be visibly recognized.

On the other hand, in the case where the illumination device is lighted, the object to be visibly recognized is illuminated by strong light from the illumination device. Therefore, even the light included in the second range of angle in the light reflected by the object to be visibly recognized to be directed to the plate-like panel can pass through the second range of angle having low transmittance so as to be directed from the inside of the accommodation body to the player through the plate-like panel. Therefore, in the case where the illumination device is lighted, the light illuminating the object to be visibly recognized can reach the player. The situation thus arises in which it becomes easy for the player to visibly recognize the object to be visibly recognized if the player turns his/her eyes to the object to be visibly recognized.

Furthermore, the embodiment of the gaming machine according to the present invention is that:

upon lighting the illumination device in response to the control signal, light emitted from the illumination device is reflected in the inside of the accommodation body to illuminate the object to be visibly recognized, and the light illuminated the object to be visibly recognized is transmitted toward the front of the display through the second range of angle.

In the light emitted from the illumination device, the light entered into to plate-like panel with the second range of angle has low transmittance and high reflectivity in the second range of angle, and thus is easy to be reflected by the plate-like panel. Therefore, a part of light emitted from the illumination device is repeatedly reflected inside of the accommodation body. Accordingly, the object to be visibly recognized can be illuminated by not only the direct light emitted form the illumination device but also the indirect light generated by repeated reflection, so that the object to be visibly recognized can be uniformly illuminated. Furthermore, in the case where the illumination device is lighted, strong light is emitted from the illumination device. Therefore, much amount of light entered into the plate-like panel with the second range of angle is reflected by the plate-like panel, whereas the light passing through the plate-like panel also increases in accordance with the intensity. Therefore, the light illuminating the object to be visibly recognized can be transmitted even with the second range of angle, so that the player can visibly recognize the image of the object to be visibly recognized.

Furthermore, the embodiment of the gaming machine according to the present invention is that:

the presentation effect device is provided on the upper side of the gaming machine;

the plate-like panel has a front face panel (such as a front face panel 310) arranged on the front side of the gaming machine; and the front face panel is arranged to be raised with increasing distance from the front side of the gaming machine.

The second range of angle is larger than the predetermined angle of incidence. Therefore, the front panel of the presentation effect device is arranged to be gradually raised with increasing distance from the front side of the gaming machine, so that the second range of angle can be directed toward the player, and also the line of sight of the player can be included within the second range of angle upon the player turning his/her eyes upward toward the object to be visibly recognized.

<<<Overall Structure of a Gaming Machine 10>>>

Figure 2:
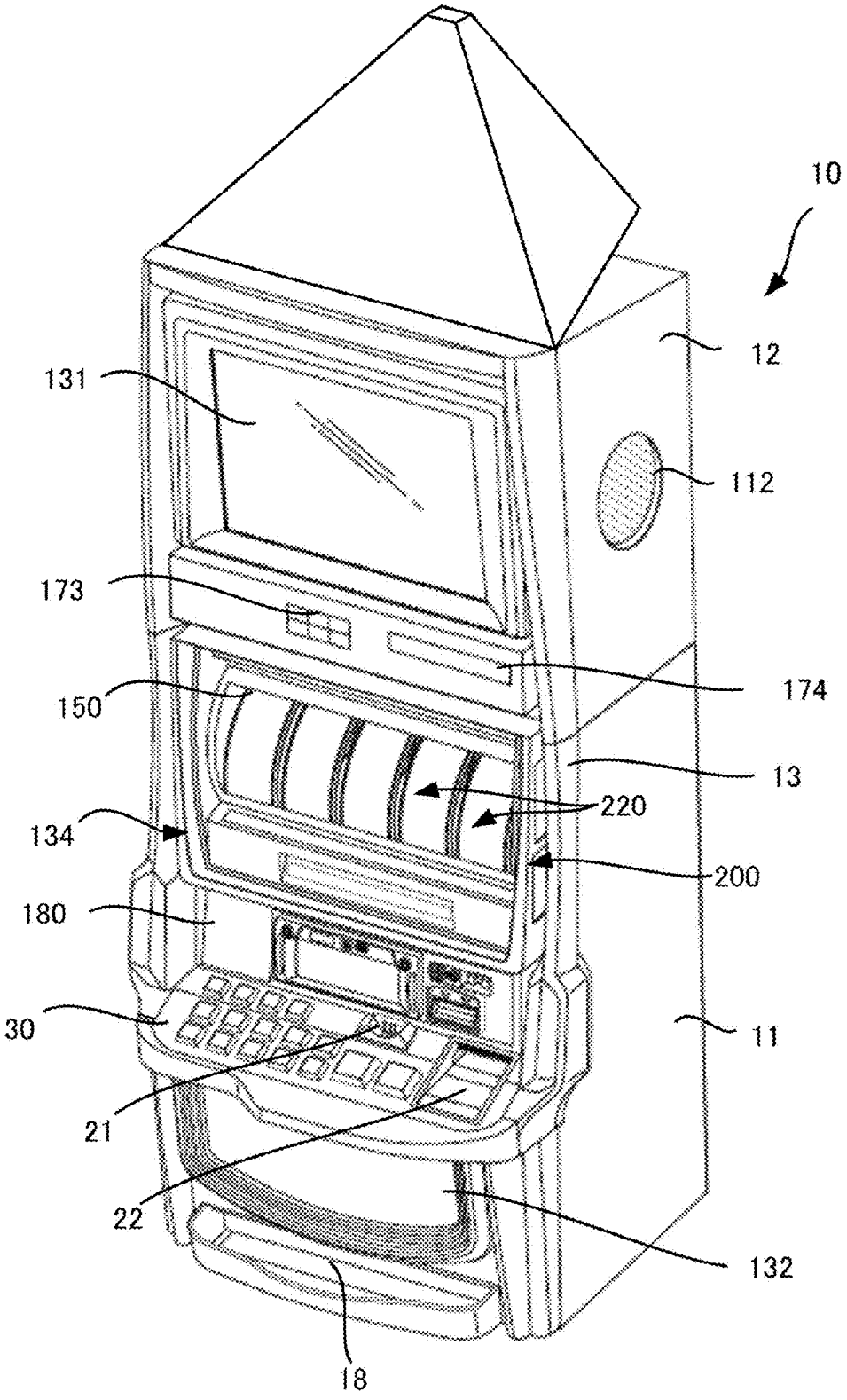
FIG. 2 is a perspective view showing an overall structure of the gaming machine 10 according to an embodiment of the present invention.

FIG. 2 is a perspective view showing an overall structure of a gaming machine 10 according to an embodiment of the present invention.

The gaming machine 10 uses coins, bills, or electronic valuable information corresponding to those as a gaming medium.

The gaming machine 10 is provided with a cabinet 11, a top box 12 installed on the upper side of the cabinet 11, and a main door 13 provided on the front surface of the cabinet 11.

The main door 13 is provided with a reel device 200. The reel device 200 is provided with a reel cover 134 on the front surface thereof.

The reel cover 134 has a display window 150 at the center thereof as shown in FIG. 2. The display window 150 makes 15 symbols 501 with five columns and three rows visible from the outside of the gaming machine 10. Three symbols 150 in each column are a part of a symbol group arranged on the outer peripheral surface of each of the reels 220*a* to 220*e*. The five reels 220*a* to 220*e* are controlled to be spun, so that the symbol 501 arranged on each of the reels 220 to 220*e* can be moved upward and downward to be displayed with changing the speed thereof as a whole. Furthermore, the five reels 220*a* to 220*e* are controlled to be stopped, the symbols 501 can be stopped to rearrange 15 symbols with five columns and three rows in the display window 150.

Although the present embodiment describes the case where the gaming machine 10 is provided with a mechanical-reel type reel device 200, a video reel in which a false reel is displayed may coexist with a mechanical reel in the gaming machine 10 of the present embodiment. Furthermore, the reel cover 134 may be provided with a touch panel. In this case, a player can operate the touch panel to input a variety of instructions. An input signal is transmitted from the touch panel to a main CPU (not shown). Furthermore, the reel cover 134 may have a transparent liquid crystal panel
or a transparent panel.

A control panel 30 is arranged on the lower side of the reel device M1. The control panel 30 is provided with various buttons, a coin entry 21 for receiving a coin into a cabinet 11, and a bill entry 22.

The control panel 30 is provided with a "RESERVE" button, a "COLLECT" button, a "GAME RULES" button, a "1-BET" button, a "2-BET" button, a "3-BET" button, a "5-BET" button, and a "10-BET" button. The "RESERVE" button, the "COLLECT" button, and the "GAME RULES" button are provided on an upper left area of the control panel 30. The "1-BET" button, the "2-BET" button, the "3-BET" button, the "5-BET" button, and the "10-BET" button are provided on a lower left area of the control panel 30. Also, the "START" button is provided on the lower center area of the control panel 30.

The "RESERVE" button is used when the player temporarily leaves the seat or when the player wants to ask a staff of the game facility to exchange money, etc. Also, the "RESERVE" button can be used to store credits remaining in an IC card inserted into the IC card reader. The "COLLECT" button is used to instruct the gaming machine 10 to pay out credited coins to a coin tray. The "GAME RULES" button is used when the player is not acquainted with game rules or operation method. When the "GAME RULES" button is pressed, various types of help information are displayed on a video display panel 131.

The "BET" buttons are used to set the betting amount. Each time the "1-BET" button is pressed, one credit among the current credits owned by the player is bet for each of the active pay lines. When the "2-BET" button is pressed, the game starts on condition that two credits are bet for each of the active pay lines. When the "3-BET" button is pressed, the game starts on condition that three credits are bet for each of the active pay lines. When the "5-BET" button is pressed, the game starts on condition that five credits are bet for each of the active pay lines. When the "10-BET" button is pressed, the game starts on condition that ten credits are bet for each of the active pay line. A spin button (a start switch) is used to instruct the initiation of spinning the reels 220*a* to 220*e* under the betting condition that is set in advance.

As shown in FIG. 2, on a lower front surface of the main door 13, i.e., at the lower part of the control panel 30, there are provided a coin receiving opening 18 for receiving a coin, and a belly glass 132 on which a character of the gaming machine 10 is painted.

An upper side image display panel 131 is provided on the front surface of the top box 12. The upper side image display panel 131 is composed of a liquid crystal panel, which constitutes a display. The upper side image display panel 131 displays the image for the presentation effect, and the image showing the introduction of contents of the game and the explanation of rules. Furthermore, the top box 12 is provided with a speaker 112. The gaming machine 10 executes the presentation effect by displaying an image, outputting sound and outputting a ray of light.

A data display unit 174 and a key pad 173 are provided in the lower part of the upper image display panel 131. The data display unit 174 is composed of a luminescent display, an LED and the like, and is for displaying data relating to a member that is read from the IC card 500 inserted by way of a PTS terminal 180, and data input by a player via the key pad 173. The key pad 173 is for inputting data.

The gaming machine 10 also has a controller 50. The controller 50 is mainly composed of a CPU (central processing unit), a ROM (read-only memory), an RAM (random access memory), etc. The controller 50 receives a signal transmitted from a variety of buttons provided on the control panel 30 to execute a variety of controls. For example, the control is executed in which the operation of the spin button is detected, followed by rearranging the symbol 501 in the display window 150 by controlling the five reels 220*a* to 220*e* to be spun and stopped. The controller 50 controls a game by the rearrangement of symbols, and transmits a control signal to a light source 352 of the presentation effect device 300 described below based on the state of the game. The control signal controls lighting, extinguishing, blink, light emission color, light emission intensity, etc.

<<The Presentation Effect Device 300>>

As shown in FIG. 2, the presentation effect device 300 according to the present embodiment is provided on the upper portion of the top box 12.

Figure 3A:
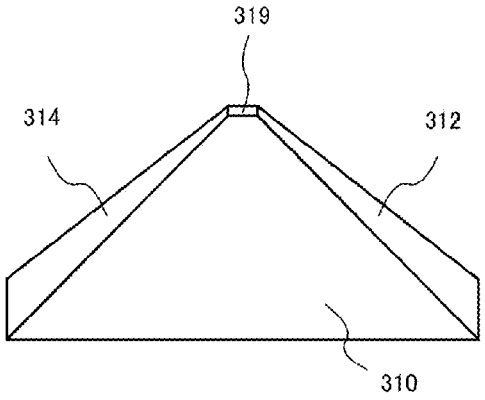
FIG. 3A is a front view showing a presentation effect device 300 according to an embodiment of the present invention.
Figure 3C:
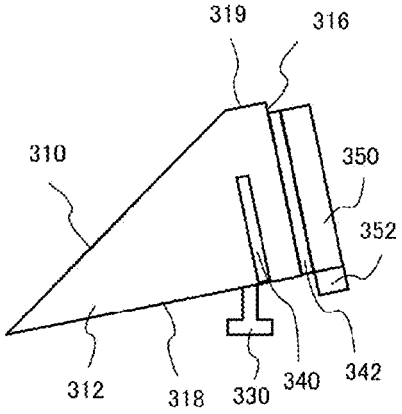
FIG. 3C is a side view thereof.
Figure 3B:
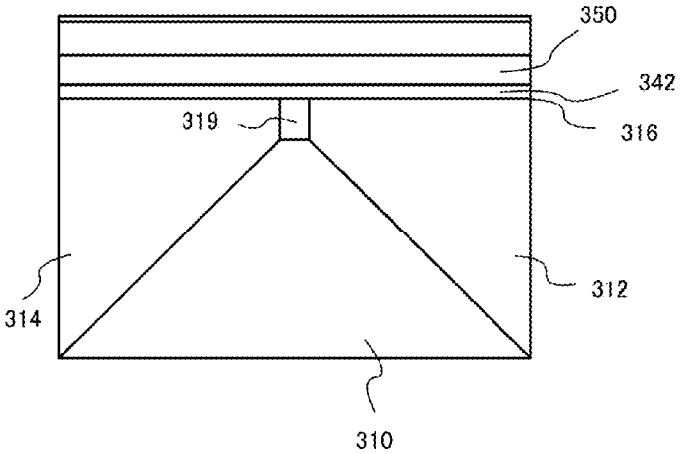
FIG. 3B is a plan view thereof.

FIG. 3A is a front view showing a presentation effect device 300 according to an embodiment of the present invention; FIG. 3B is a plan view thereof; and FIG. 3C is a side view thereof. As shown in FIGS. 3A to 3C, the presentation effect device 300 according to the present embodiment has a shape of substantially truncated square pyramid.

The presentation effect device 300 has a front face panel 310, a right side face panel 312, a left side face panel 314, a rear panel 316 and a bottom surface 318. The front face panel 310, the right side face panel 312, the left side face panel 314 and the rear panel 316 are rectangular in shape. Specifically, a trapezoid is preferable which is a rectangular shape having a pair of opposite sides in parallel with each other. In particular, the front face panel 310 is preferably an isosceles trapezoid. In this manner, the front face panel 310, the right side face panel 312, the left side face panel 314 and the rear panel 316 have a shape with an upper side and a lower side. The bottom surface 318 has a substantially rectangular shape. Furthermore, the presentation effect device 300 has a square top portion 319. The square top portion 319 supports the front face panel 310, the right side face panel 312, the left side face panel 314 and the rear panel 316.

<The Front Face Panel 310, the Right Side Face Panel 312 and the Left Side Face Panel 314>

Each of the front face panel 310, the right side face panel 312 and the left side face panel 314 is formed by a transparent flat plate-like panel. For example, it may be able to be structured by a material having a translucency, such as acryl, plastic, glass, etc.

The presentation effect device 300 has a shape of a substantially truncated square pyramid. Specifically, the front face panel 310 is gradually raised toward the depth of the gaming machine 10. The right side face panel 312 is gradually raised toward left of the gaming machine 10. The left side face panel 314 is gradually raised toward right of the gaming machine 10. In this manner, each of the front face panel 310, the right side face panel 312 and the left side face panel 314 is arranged so as to be inclined at a predetermined angle to the vertical direction.

The front face panel 310 is arranged so as to be gradually raised from the front of the gaming machine 10 toward the depth thereof toward the direction away from a player. Specifically, the front face panel 310 is arranged so that the upper side of the front face panel 310 is inclined backward to the lower side of the front face panel 310.

The right face panel 312 is gradually raised toward left of the gaming machine 10. Specifically, the right face panel 312 is arranged so that the upper side of the right face panel 312 is inclined leftward to the lower side of the right face panel 312.

The left face panel 314 is gradually raised toward right of the gaming machine 10. Specifically, the left face panel 314 is arranged so that the upper side of the left face panel 314 is inclined rightward to the lower side of the left face panel 314.

A space surrounded by the front face panel 310, the right side face panel 312, the left side face panel 314, the rear panel 316 and the bottom surface 318 define an accommodation space S for accommodating an object to be visibly recognized 340.

<Beam Splitter 320 (Magic Minor (One-Way Mirror))>

A beam splitter 320 (refer to FIGS. 5A and 5B) is provided in each of the front face panel 310, the right side face panel 312, the left side face panel 314, the rear panel 316, the bottom surface 318 and the top portion 319. In the present embodiment, the beam splitter 320 is in a shape of a sheet with flexibility. The beam splitter 320 provided in each of the front face panel 310, the right side face panel 312, the left side face panel 314, the bottom surface 318 and the top portion 319 has a shape and a size that is substantially same as those of each of the front face panel 310, the right side face panel 312, the left side face panel 314, the bottom surface 318 and the top portion 319. The beam splitter 320 is bonded to be in close contact with each of the front face panel 310, the right side face panel 312, the left side face panel 314, the bottom surface 318 and the top portion 319.

The beam splitter 320 is an optical member referred to as a so-called magic mirror (one-way mirror). The beams splitter 320 reflects a part of entered light and passes a part thereof therethrough so as to divide the entered light into reflected light and transmitted light. The beam splitter 320 is formed so that a thin film such as metal is evaporated onto a transparent sheet for a base material. Thickness of the thin film to be formed can adjust the ratio of the reflection light and the transmitted light, and an appropriate transmittance and reflectivity can be defined. A thin film with a small amount of thickness increases the transmittance, whereas a thin film with a large amount of thickness increases the reflection light.

The transmittance and reflectivity of the beam splitter 320 depend on an angle of incidence of light (dependence on an incidence angle). When the angle of incidence is small ranging 0° to a predetermined angle, the entered light is easy to be passed therethrough and difficult to be reflected. In contrast, when the angle of incidence is larger than the predetermined angle, the entered light is difficult to be passed therethrough and easy to be reflected compared to the aforementioned case.

Figure 5A:
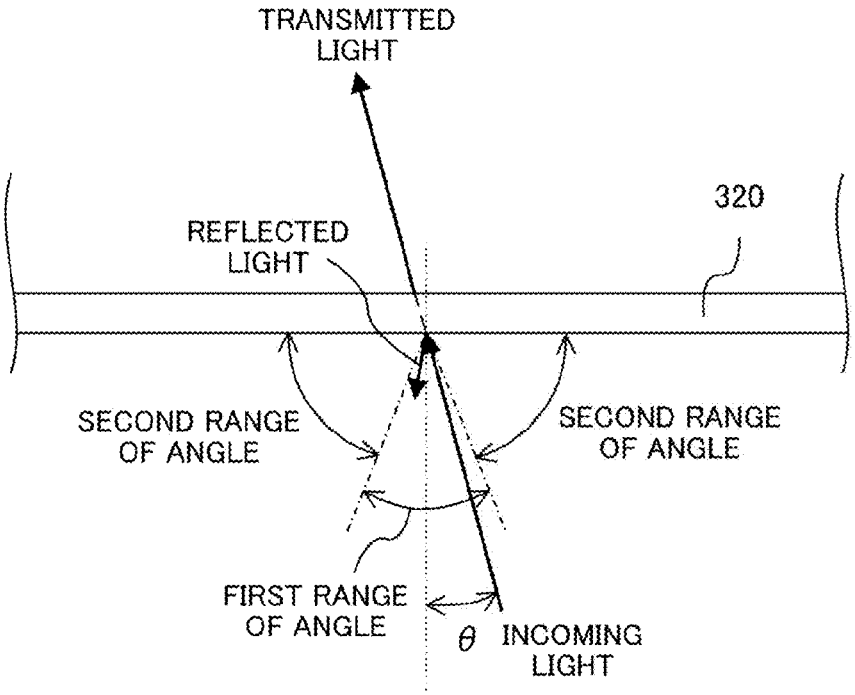
FIGS. 5A and 5B are diagrams showing incoming light entering into a beam splitter 320 and reflection light reflected by the beam splitter 320.

As shown in FIG. 5A, when the angle of incidend θ is small and is included within a first range of angle, the light entered into the beam splitter 320 is easy to be passed therethrough and difficult to be reflected. More specifically the beam splitter 230 divides the entered light so as to increase in the amount of the light passing through the beam splitter 320, and decrease in the amount of the light reflected by the beam splitter 320.

Figure 5B:
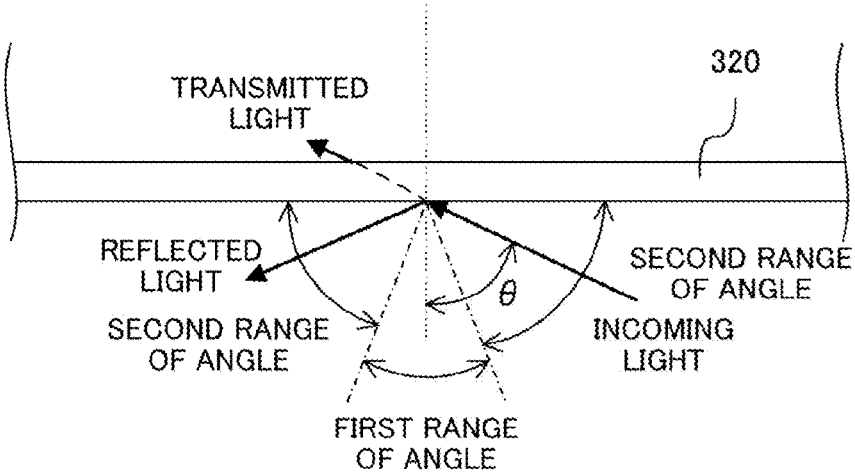

As shown in FIG. 5B, when the angle of incidence of the light entering into the beam splitter 320 is included within a second range of angle, the amount of the light passing through the beams splitter 320 is smaller than the case of the first range of angle. Therefore, in the case where an image of an object is to be formed through the beams splitter 320 with the second range of angle, most of the light for forming the image of the object is reflected by the beam splitter 320. Therefore, the beam splitter does not pass the enough amount of light for forming the image of the object therethrough, so that it becomes difficult to form the image of the object through the beams splitter 320.

As described above, the beam splitter 320 is an optical element for dividing the light entering thereinto into the refection light and the transmitted light. Therefore, when the image of the object is to be formed with the second range of angle, it is effective to previously increase the intensity of light to be entered so that the efficient amount of light passes through the beam splitter 320 even if the light is divided by the beam splitter 320. For example, the object is illuminated by a light source so that the intensity of light exit from the object, so that it is possible to increase the amount of light passing through the beam splitter 320. In this manner, it is possible to form the image of the object through the beam splitter 320 with the second range of angle.

As the beam splitter 320, an optical element is preferable in which the reflectivity is set to exceed the transmittance when the angle of incidence is 45°. It is a so-called half mirror when the reflectivity is equal to the transmittance, whereas it is a so-called magic mirror when the reflectivity is larger than the transmittance. Both the half minor and the magic minor can be employed as the beam splitter 320. In this way, it is possible to further clarify the state where the objects to be visibly recognized 340 and 342 can be visibly recognized and the state where the objects cannot be visibly recognized.

<The Bottom Surface 318>

The bottom surface 318 is made of a transparent panel. For example, it may be able to be made of a transparent material such as acryl, plastic, glass, etc. The bottom surface 318 supports the front face panel 310, the right side face panel 312, the left side face panel 314 and the rear panel 316 so as to keep a shape of truncated square pyramid. The bottom surface 318 is preferably structured by a member reflecting light entered into the inside of the presentation effect device 300, i.e., a member having a mirror surface such as aluminum foil. The light entered into the bottom surface 138 reflected within the presentation effect device 300 illuminates the objects to be visibly recognized 340 and 342, so that it is possible make the light forming images of the objects to be visibly recognized 340 and 342 exit to the outside of the presentation effect device 300.

A light source (not shown) (referred to as an internal light source) may be provided on the bottom surface 318. The lighting of the internal light source also can illuminate the inside of the presentation effect device 300, and to illuminate objects to be visibly recognized described below in particular.

A supporting platform 330 is provided on the underside of the bottom surface 318. The bottom surface 318 is placed on the supporting platform 330. The supporting platform 330 makes the bottom surface 31 possible to be gradually raised toward the depth of the gaming machine 10. Such an arrangement enables the presentation effect device 300 to be inclined as a whole toward the front of the gaming machine 10, so that the inside of the presentation effect device 300 can be visibly recognized by the player and the surroundings. The presentation effect device 300 is inclined frontward makes it possible to visibly recognize the presentation effect device 300 as a whole easily by the player.

<Top Portion 319>

The top portion 319 is made of a transparent panel. For example, it may be able to be made of a transparent material such as acryl, plastic, glass, etc. The top portion 319 supports, along with the bottom surface 318, the front face panel 310, the right side face panel 312, the left side face panel 314 and the rear panel 316 so as to keep a shape of truncated square pyramid. It is preferable that the beam splitter 320 is provided on the top portion 319. Providing the beam splitter 320 makes it possible to reflect light entered into the top portion 319.

<Objects to be Recognized 340 and 342 (Objects to be Illuminated)>

Figure 4:
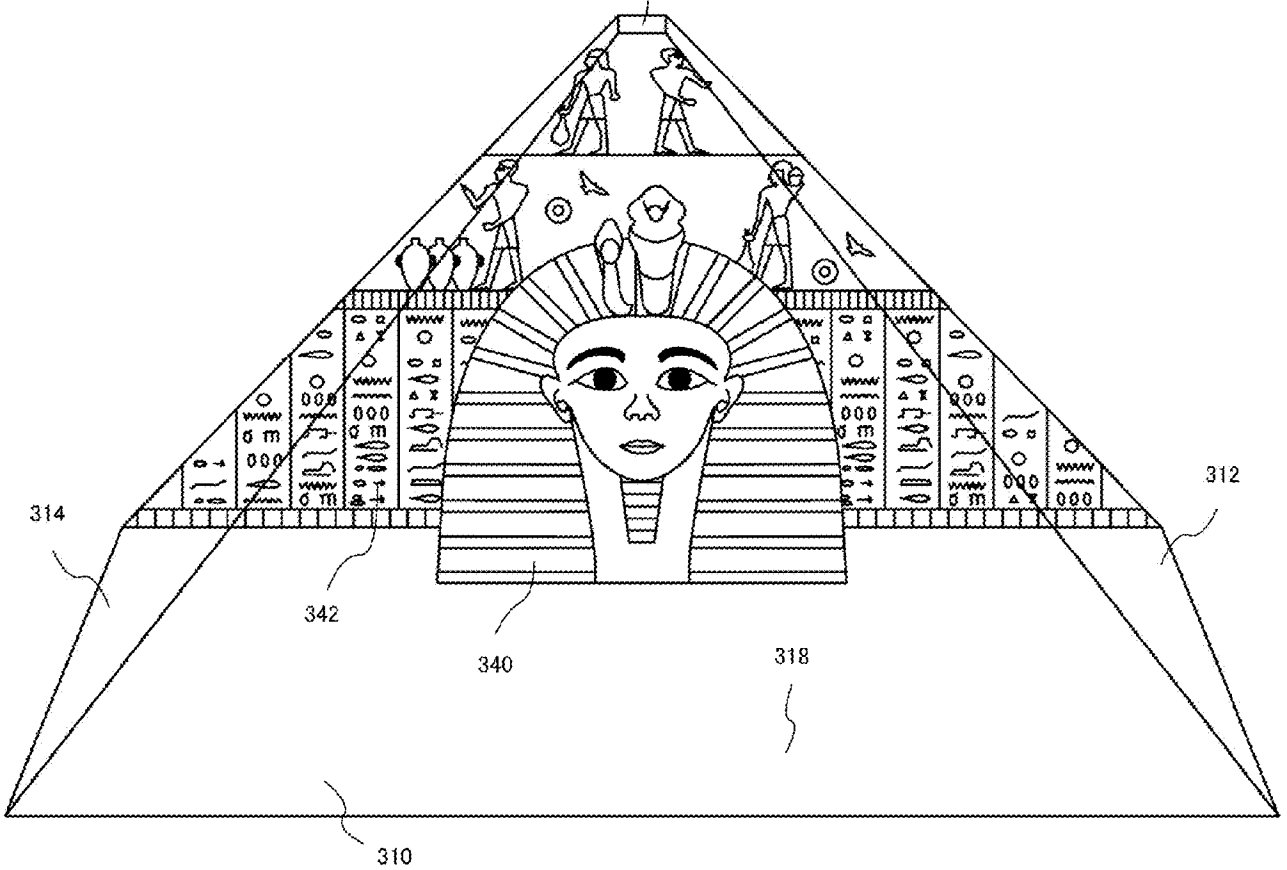
FIG. 4 is a perspective view schematically showing an outside shape and the inside of the presentation effect device 300.

The objects to be recognized 340 and 342 are provided in the presentation effect device 300. As shown in FIG. 4, an image that represents a human is painted on the objects to be recognized 340. The object to be recognized 340 is provided inside of the presentation effect device 300. The object to be recognized 340 is illuminated by a light source. As shown in FIG. 4, pictures and characters like hieroglyph are pained on the object to be recognized 340. The object to be recognized 342 is provided on the rear panel 316. The object to be visibly recognized 342 is illuminated mainly by a light source 352 described below.

<Rear Panel 316>

The rear panel 316 made of a transparent panel. For example, it may be able to be made of a transparent material such as acryl, plastic, glass, etc. The object to be visibly recognized 324 is provided on the rear panel 316. The object to be visibly recognized 324 is a sheet for a background image on which pictures and characters like hieroglyph are painted. The sheet for the background image is bonded as the object to be visibly recognized 342 to the rear panel 316.

<Light Guide Plate 350, Light Source 352 and Internal Light Source>

As shown in FIG. 3C, a light guide plate 350 is provided on the backside of the object to be visibly recognized 342 of the rear panel 316. The light guide plate 350 internally diffuses light entered thereinto to make the brightness thereof almost even, so that the light exits from a predetermined outgoing surface. The light guide plate 350 makes it possible to illuminate the object to be visibly recognized 342 bonded to the rear panel 316 with almost even brightness.

The light source 352 is provided on the lower side of the light guide plate 350. The light source 352 emits light with a predetermined wavelength, such as visible light. The light emitted from the light source 352 enters into an underside surface (entrance surface) of the light guide plate 350. This makes it possible to illuminate the object to be visibly recognized 342 bonded to the rear panel 316. The object to be visibly recognized 342 is illuminated, so that it is possible for a player to recognize the presence of the object to be visibly recognized 342, thereby raising the expectation to the game.

In addition, a plurality of light source, such as internal light sources (i.e., light emitting diodes) may be provided inside of the presentation effect device 300. The object to be visibly recognized 340 can be illuminated also by those internal light sources. The object to be visibly recognized 340 is illuminated, so that it is possible for a player to recognize the presence of the object to be visibly recognized 340, thereby raising the expectation to the game.

<<Visible Recognition of Objects to be Visibly Recognized 340 and 342 by a Player>>

Figure 6:
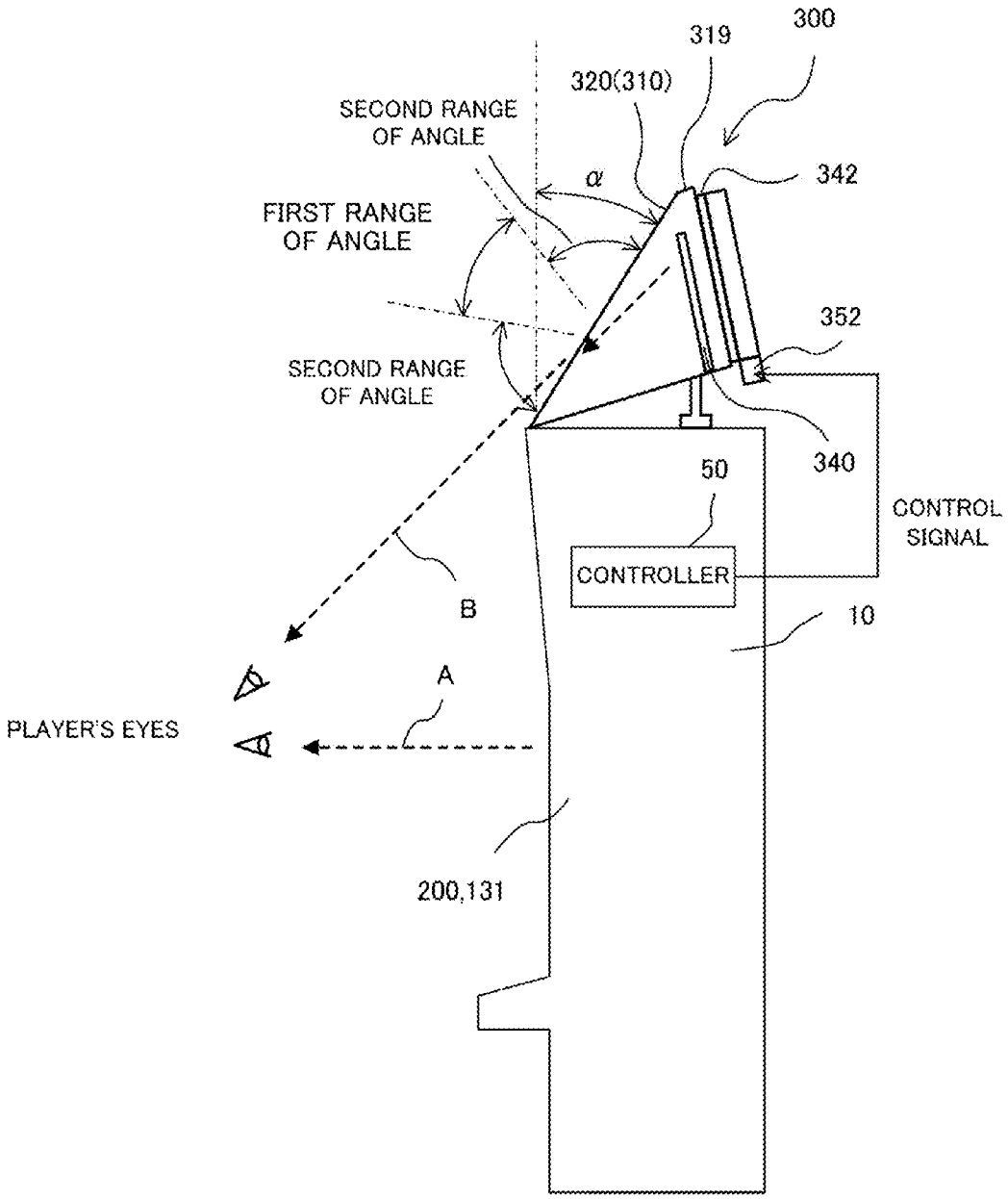
FIG. 6 is a side view seeing the gaming machine 10 from the side thereof.

FIG. 6 is a side view seeing the gaming machine 10 from the side thereof.

The player sits in front of the gaming machine 10 to play a game. In the case where a game goes on in which symbol are rearranged, such as a baseball game, a bonus game, a free game, a feature game, etc., light emitted from the reel device 200 or the upper image display panel 131 travels in the horizontal direction as indicated by an arrow A to enter into eyes of the player.

As shown in FIG. 6, the presentation effect device 300 is provided on the upper side of the gaming machine 10. Specifically, it is placed on the upper side of the top box. The light emitted from the presentation effect device 300 travels downward as indicated by an arrow B to enter into eyes of the player.

<<Illumination Inside of the Presentation Effect Device 300>>

Figure 7:
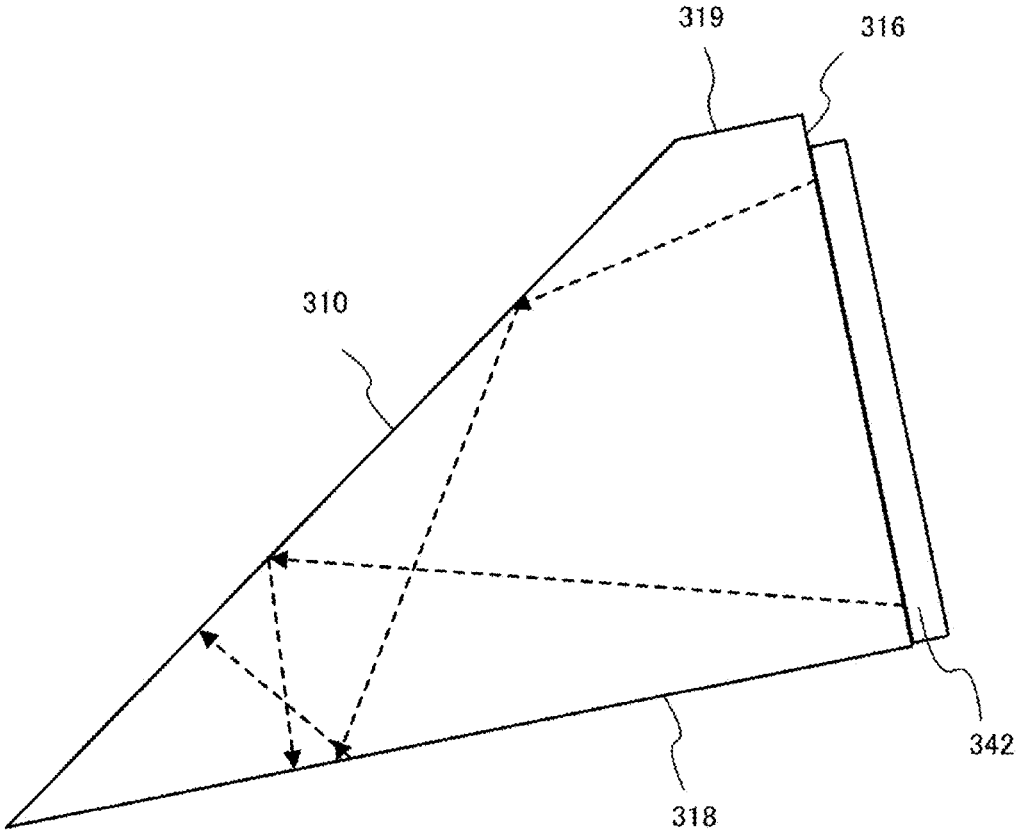
FIG. 7 is a schematic diagram showing light reflected by a front face panel 310, a right side face panel 312, a left side surface 314, a bottom surface 318, and a top portion 318.

Emitting light from the light source 352 or the internal light source illuminates the inside of the presentation effect device 300. A part of the light emitted from the light source 342 or the internal light source passes through the front face panel 310, the right side face panel 312 and the left side face panel 314 to exit from the presentation effect device 300. A part of the remaining light is reflected by the front face panel 310, the right side face panel 312 and the left side face panel 314 as shown in FIG. 7, to again return into the inside of the presentation effect device 300, and then reaches the front face panel 310, the right side face panel 312 and the left side face panel 314. Furthermore, a part thereof passes through the front face panel 310, the right side face panel 312, the left side face panel 314, the bottom surface 318 and the top portion 319, and the rest thereof is reflected.

As described above, a part of light emitted from the light source 352 and the internal light source is repeatedly reflected by the front face panel 310, the right side face panel 312, the left side face panel 314, the bottom surface 318 and the top portion 319. Specifically, the inside of the presentation effect device 300 serves as the light guide plate to excite reflection repeatedly. The repeated reflection makes it possible to generate light travelling in various directions inside the presentation effect device 300. The light of this kind can illuminate the inside of the presentation effect device 300 as a whole. Illumination by the light traveling in various directions can prevent the object such as the object to be visibly recognized 340 and the like from making a shadow thereof if it exists within the presentation effect device 300. Furthermore, it is possible to illuminate the object such the object to be visibly recognized 340 from various directions with the brightness almost even brightness.

<<Light Emission Control of the Light Source 352 and the Internal Light Source>>

The control is executed on lighting, extinguishing, blink, color and intensity of light, etc., of the light source 352 and the internal light source as the game played in the gaming machine 10 goes on. For example, in accordance with the case of obtaining a predetermined result of lottery such as winning, the case of the bonus game, or the case of the free game, a control signal is transmitted from the controller 50 of the gaming machine 10 to a drive circuit (not shown) of the light source 352 (refer to FIG. 6). The drive circuit of the light source 352 and the internal light source controls lighting, extinguishing, blink, color and intensity of light, etc., of the light source 352 in response to the supplied control signal.

<<Location of the Presentation Effect Device 300>>

The example described above has shown the case where the presentation effect device 300 is provided on the upper portion of the top box 12. However, the gaming machine 10 can be provided with the presentation effect device 300 as the top box 12 if the condition, such as the direction of line of sight of a player, the second range of angle, is met.

<<Illuminations Form the Outside and Inside of the Presentation Effect Device 300>>>

Figure 8:
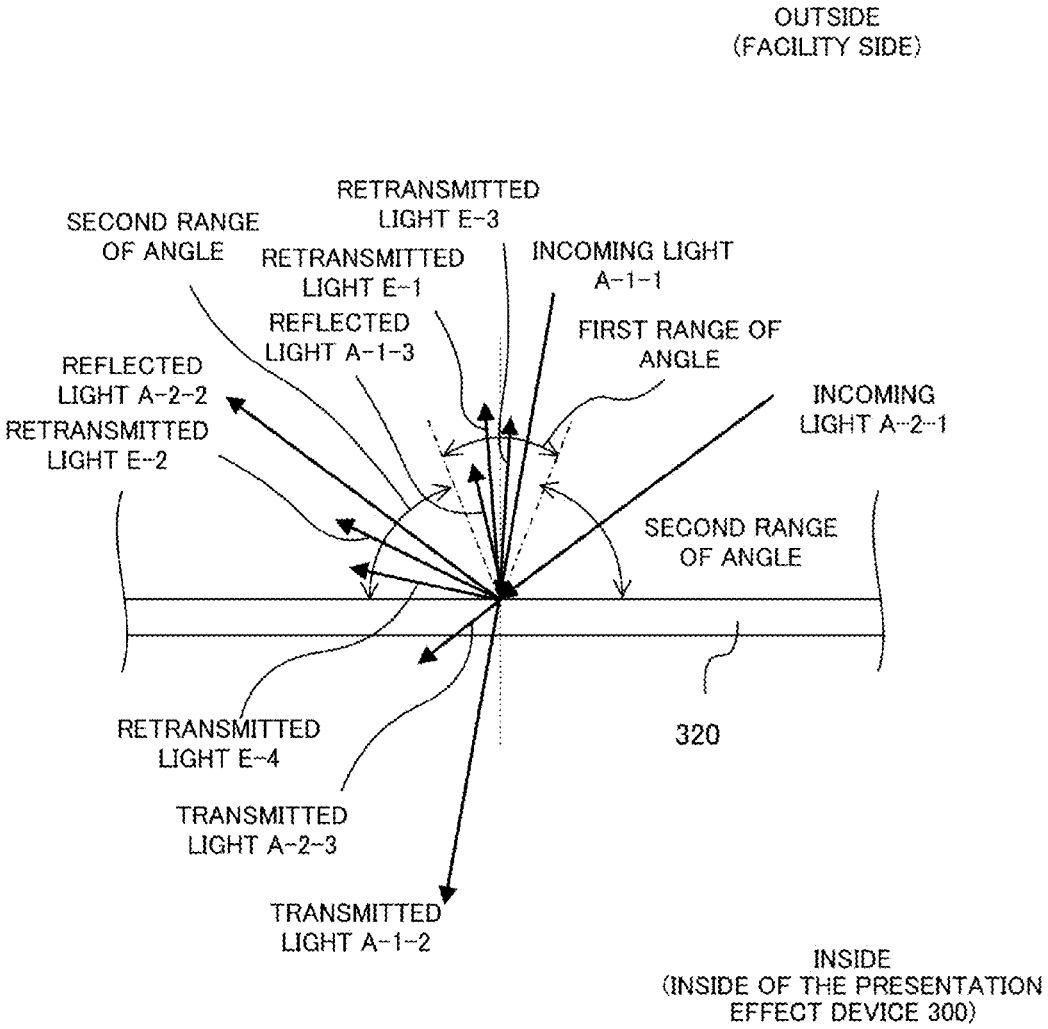
FIG. 8 is a diagram showing the relationship among incoming light, reflection light and transmitted light from light source of the outside of the presentation effect device 300, i.e., by illumination of a facility.
Figure 9:
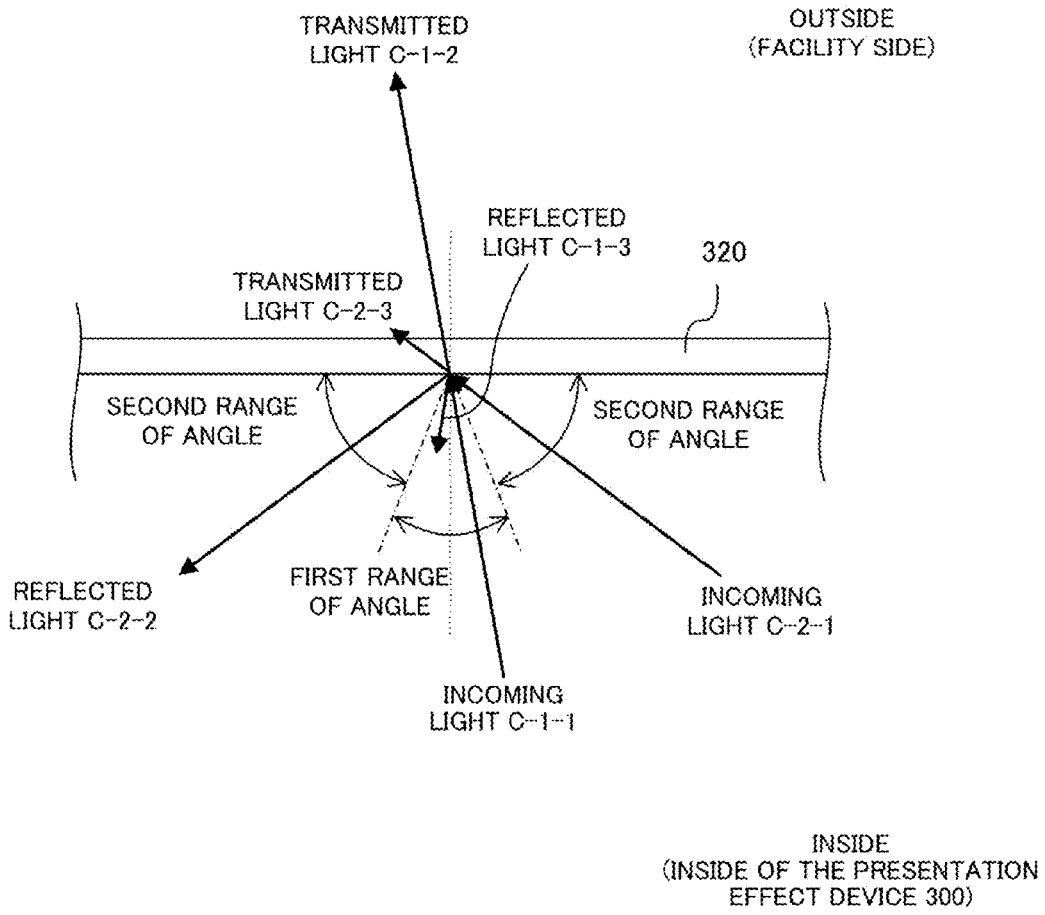
FIG. 9 is a diagram showing the relationship among incoming light, reflection light and transmitted light from light source of the outside of the presentation effect device 300, i.e., by a light source 352 and an internal light source.

FIG. 8 is a diagram showing the relationship among incoming light, reflected light and transmitted light by the light source from the outside of the presentation effect device 300, i.e., by illumination of a facility. FIG. 9 is a diagram showing the relationship among incoming light, reflected light and transmitted light by the light source from the inside of the presentation effect device 300, i.e., by the light source 352 and the internal light source.

<<Illumination Form the Outside of the Presentation Effect Device 300>>

As shown in FIG. 8, when the light source outside the presentation effect device 300 (illumination of a facility) is lighted, the beam splitter 320 receives incoming light A-1-1 with the first range of angle, and incoming light A-2-1 with the second range of angle. As described above, if the intensity of the incoming light A-1-1 becomes equal to the intensity of the incoming light A-2-1, the incoming light A-1-1 entering with the first range of angle is difficult to be reflected but easy to be passed therethrough than the incoming light A-2-1 entering with the second range of angle.

<<Incoming Light A-1-1, Transmitted Light A-1-2, Reflected Light A-1-3>>

The intensity of transmitted light A-1-2 passing through the beam splitter 320 in the incoming light A-1-1 entering into the beam splitter 320 with the first range of angle is higher than the intensity of transmitted light A-2-3 passing through the beam splitter 320 in the incoming light A-2-1. The intensity of reflected light A-1-3 reflected by the beam splitter 320 in the incoming light A-1-1 is lower than the intensity of reflected light A-2-2 in the incoming A-2-1 reflected by the beam splitter 320.

<Retransmitted Light E-1>

The transmitted light A-1-2 passes through the beam splitter 320 to travel into the presentation effect device 300, thereby illuminating the objects to be visibly recognized 340 and 342 of the presentation effect device 300 (refer to FIGS. 3A to 3C and FIG. 6). The transmitted light A-1-2 illuminates the objects to be visibly recognized 340 and 342, followed by being reflected by the panel such as the front face panel 310 in the inside of the presentation effect device 300. When returned to the beam splitter 320 by the reflection by the panel, the transmitted light A-1-2 passes through the beam splitter 320 again to exit therefrom (retransmitted light E-1 in FIG. 8). As shown in FIG. 8, since the retransmitted light E-1 is included in the first range of angle, the retransmitted light E-1 travels toward a player if the direction of line of sight of the player is included in the first range of angle.

<Retransmitted Light E-2>

The transmitted light A-1-2 illuminates the objects to be visibly recognized 340 and 342, and then returns to the beam splitter 320 so as to be included in the second range of angle, thereby again passing through the beam splitter 320 to exit therefrom (retransmitted light E-2 in FIG. 8). Since the retransmitted light E-2 is included in the second range of angle, the retransmitted light E-2 travels toward a player if the direction of line of sight of the player is included in the first range of angle.

<Retransmitted Light E-3>

The transmitted light A-2-3 passes through the beam splitter 320 to travel into the presentation effect device 300, thereby illuminating the objects to be visibly recognized 340 and 342 of the presentation effect device 300 (refer to FIGS. 3A to 3C and FIG. 6). The transmitted light A-2-3 illuminates the objects to be visibly recognized 340 and 342, followed by being reflected by the panel such as the front face panel 310 in the inside of the presentation effect device 300. When returned to the beam splitter 320 by the reflection by the panel, the transmitted light A-2-3 passes through the beam splitter 320 again to exit therefrom (retransmitted light E-3 in FIG. 8), similar to the retransmitted light E-1. Since the retransmitted light E-3 is included in the first range of angle, the retransmitted light E-3 travels toward a player if the direction of line of sight of the player is included in the first range of angle.

<Retransmitted Light E-4>

A light (retransmitted light E-4) exists in which the light that is the transmitted light A-2-3 illuminating the objects to be visibly recognized 340 and 342 is included in the second range of angle when returning again to the beam splitter 320, and then passes through the beam splitter 320 to exits therefrom, similar to the retransmitted light E-2. Since the retransmitted light E-4 is included in the second range of angle, the retransmitted light E-4 travels toward a player if the direction of line of sight of the player is included in the second range of angle.

<<Light from the Light Source 352 and the Internal Light Source>>

As described above, emitting light from the light source 352 and the internal light source can illuminate the inside of the presentation effect device 300. The inside of the presentation effect device 300 serves as the light guide plate to excite reflection repeatedly. The repeated reflection makes it possible to generate light travelling in various directions inside the presentation effect device 300. In the light generated in this manner, the light reached the beam splitter 320 becomes incoming light C-1-1 and incoming light C-2-1 as shown in FIG. 9.

When the intensity of the incoming light C-1-1 is equal to the incoming light C-2-1, the intensity of incoming light C-1-2 passing through the beam splitter 320 in the incoming light C-1-1 entering with the first range of angle is higher than the intensity of the incoming light C-2-3 in the incoming light C-2-1. The intensity of reflected light C-1-3 reflected by the beam splitter 320 in the incoming light C-1-1 is lower than that of reflected light C-2-2 in the incoming C-2-1 reflected by the beam splitter 320.

<Transmitted Light C-1-2>

The transmitted light C-1-2 passes through the beam splitter 320 with the first range of angle. Therefore, the transmitted light C-1-2 acts similar to the retransmitted lights E-1 and E-3 described above to compensate the intensity of the retransmitted lights E-1 and E-3.

<Transmitted Light C-2-3>

The transmitted light C-2-3 passes through the beam splitter 320 with the second range of angle. Therefore, the transmitted light C-2-3 acts similar to the retransmitted lights E-2 and E-4 described above to compensate the intensity of the retransmitted lights E-2 and E-4.

<<The Case where Line of Sight of a Player is Included in the First Range of Angle>>

<Illumination Light of a Facility>

As described above, the reflected light A-1-3 is reflected by the beam splitter 320 with the first range of angle. Furthermore, the retransmitted lights E-1 and E-3 exit from the beam splitter 320 with the first range of angle. When line of sight of a player is included in the first range of angle, player's eyes receive the reflected light A-1-3 and the retransmitted lights E-1 and E-3.

As the intensity of the retransmitted light E-1 and that of the retransmitted light E-3 become closer to the intensity of the reflected light A-1-3, an image of the retransmitted lights E-1 and E-3 become easier to be caught by the player's eyes than an image of the reflected light A-1-3. Since the retransmitted lights E-1 and E-3 are the light which illuminates the objects to be visibly recognized 304 and 342, the player resultingly visibly recognizes the inside of the presentation effect device 300.

When the intensity of the reflected light A-1-3 is sufficiently higher than the intensity of the retransmitted light E-1 and that of the retransmitted light E-3, the image of the reflected light A-1-3 becomes easier to be caught by the player's eyes than the image of the retransmitted lights E-1 and E-3. Since the reflected light A-1-3 is not the light which illuminates the objects to be visibly recognized 304 and 342, the player is in the state where it is difficult to visibly recognize the inside of the presentation effect device 300.

In this manner, there arise both the case where a player can visibly recognize the objects to be visibly recognized 340 and 342 and the case where a player cannot visibly recognize the object in accordance with the relationship between the intensity of the retransmitted light E-1 and that of the retransmitted light E-2, and the reflected light A-1-3, depending on the intensity of illumination light of the facility.

<The Light Source 352 and the Internal Light Source>

As descried above, the transmitted light C-1-2 passes through the beam splitter 320 with the first range of angle. When the light source 352 and the internal light source are lighted, the transmitted light C-1-2 compensates the retransmitted light E-1 and the retransmitted light E-3, and the intensity of the retransmitted light E-1, the retransmitted light E-3 and the transmitted light C-1-2 is resultingly sufficiently higher than the intensity of the reflected light A-1-3. Therefore, the image of the retransmitted light E-1, the retransmitted light E-3 and the transmitted light C-1-2 is easier to be caught by the player's eyes than the image of the reflected light A-1-3. Since the retransmitted light E-1, the retransmitted light E-3 and the transmitted light C-1-2 are the lights which illuminate the objects to be visibly recognized 340 and 342, the player resultingly visibly recognizes the inside of the presentation effect device 300.

<<The Case where Line of Sight of a Player is Included in the Second Range of Angle>>

<Illumination Light of a Facility>

As described above, the reflected light A-2-2 is reflected by the beam splitter 320 with the second range of angle. Furthermore, the retransmitted lights E-2 and E-4 exit from the beam splitter 320 with the second range of angle. When line of sight of a player is included in the second range of angle, player's eyes receive the reflected light A-2-2 and the retransmitted lights E-2 and E-4.

According to the angle of incidence to the beam splitter 320, the reflected light A-2-2 is larger than the reflected light A-1-3, and the retransmitted lights E-2 and E-4 are smaller than the retransmitted lights E-1 and E-3.

Therefore, the difference between the intensity of the reflected light A-2-2 and the intensity of the retransmitted lights E-2 and E-4 is larger than the difference between the reflected light A-1-3 and the intensity of the retransmitted lights E-1 and E-3. Therefore, the inside of the presentation effect device 300 is difficult to be visibly recognized by a player with the second range of angle rather than with the first range of angle. This makes it possible to make the inside of the presentation effect device 300 difficult to be visibly recognized even if the illumination of the facility is weak.

<The Light Source 352 and the Internal Light Source>

As described above, the transmitted light C-2-3 passes through the beam splitter 320 with the first range of angle. When the light source 352 and the internal light source are lighted, the transmitted light C-2-3 compensates the retransmitted light E-2 and the retransmitted light E-4, and the intensity of the retransmitted light E-2, the retransmitted light E-4 and the transmitted light C-2-3 is resultingly sufficiently higher than the intensity of the reflected light A-2-2. Therefore, the image of the retransmitted light E-2, the retransmitted light E-4 and the transmitted light C-2-3 is easier to be caught by the player's eyes than the image of the reflected light A-2-2. Since the retransmitted light E-2, the retransmitted light E-4 and the transmitted light C-2-3 are the lights which illuminate the objects to be visibly recognized 340 and 342, the player resultingly visibly recognizes the inside of the presentation effect device 300.

As described above, if the direction of line of sight of the player is included in the first range of angle, there arise both the case where a player can visibly recognize the objects to be visibly recognized 340 and 342 and the case where a player cannot visibly recognize the object, if there is only the illumination light of the facility. On the other hand, when the light source 352 and the internal light source are lighted, the player can visibly recognize the objects to be visibly recognized 340 and 342.

Furthermore, if the direction of line of sight of the player is included in the second range of angle, there is no case where a player can visibly recognize the objects to be visibly recognized 340 and 342 if there is only the illumination light of the facility. On the other hand, when the light source 352 and the internal light source are lighted, the player can visibly recognize the objects to be visibly recognized 340 and 342.

In this manner, the presentation effect device 3300 is provided so that the direction of line of sight of player's eyes is included in the second range of angle, so that it is possible to clearly change from the state where the player can visibly recognize the inside of the presentation effect device 300 to the state where a player cannot visibly recognize it.

In recent years, not only the presentation effect by the gaming machine but also the presentation effect by the facility becomes decorative. For example, the whole of the facility may be made darkened in order to provide an upscale image, brighter illumination may be employed in order to provide the soundness, and the illumination may blink or the brightness of light may be changed in order to give an impact. Furthermore, the illumination may be changed depending on time such as morning, afternoon, night, etc. In this manner, the illumination in the facility may not even in the brightness thereof, or may vary for each facility.

Therefore, when the presentation effect using light is provide for the gaming machine, it is possible to customize the gaming machine taking brightness and color arrangement into consideration depending on the facility to be installed therein. However, in order to be tailored to the circumstances for each facility, it is necessary to prepare a lamp to correspond to the appropriate brightness, or prepare an available background. In addition thereto, when the facility is renovated, it is also necessary to do a rework tailored thereto. Therefore, it must be complicated because of much expense in time and effort for preparing and changing for the presentation effect using light.

Furthermore, it is possible to provide various sensors for the gaming machine to detect brightness and color of light in the facility, thereby determining the intensity and color of the lamp in accordance with the detected result to control the lamp. However, in order to carry out such a control, it is necessary to provide a sensor for the gaming machine, as well as create a control program for controlling a lamp in response to the output signal transmitted from the sensor. This makes the structure intricate, and also some time and effort required for the development makes it complicated, so that it must be expensive.

As described above, the presentation effect device 3300 is provided so that the direction of line of sight of player's eyes is included in the second range of angle, so that it is possible to adequately change from the state where the inside of the presentation effect device 300 can be visibly recognized to the state where it cannot be visibly recognized. In this manner, the presentation effect using light can be carried out with efficiency independent on the circumstances that the gaming machine is installed, as well as at low cost and with a simple structure.

REFERENCE SIGNS LIST

10 Gaming machine
300 Presentation effect device
310 Front panel (Plate-like panel)
312 Right side face panel
314 Left side face panel
320 Beam splitter
340, 342 Object to be visibly recognized
352 Light source (Illumination device)

What is claimed is:

1. A gaming machine, comprising:

a presentation effect device, comprising an accommodation body that is defined by a plurality of face panels and accommodates an object to be visibly recognized, a plate-like panel that forms at least one face panel among the plurality of face panels defining the accommodation body, and an illumination device that illuminates the object to be visibly recognized by a control signal, wherein the plate-like panel is composed of a beam splitter for dividing incoming light into reflection light and transmitted light and the presentation effect device is positioned on an upper side of the gaming machine such that a player views the reflection light from the beam splitter at a first angle relative to a position of the player;

a plurality of reels that rearrange symbols wherein the reels are positioned in the gaming machine relative to the position of the player such that the player views the reels at a second angle relative to the position of the player; and a controller that controls a game of the rearrangement of the symbols, and for transmitting the control signal based on a state of the game, wherein surfaces of the plurality of face panels are inclined in an upward direction such that the first angle is an upward angle relative to the second angle.

2. The gaming machine according to claim 1, wherein the object to be visibly recognized is provided on an upper side of the reels.

3. A gaming machine, comprising:

a presentation effect device comprising an accommodation body that is defined by a plurality of face panels and accommodates an object to be visibly recognized, a plate-like panel that forms at least one face panel among the plurality of face panels defining the accommodation body, and an illumination device that illuminates the object to be visibly recognized in response to a control signal;

a plurality of reels that rearrange symbols wherein the reels are positioned in the gaming machine relative to a position of a player such that the player views the reels at a first angle relative to the position of the player; and a controller that controls a game of the rearrangement of the symbols, and for transmitting the control signal based on a state of the game, wherein:

the plate-like panel has a beam splitter dividing incoming light entering into the plate-like panel into reflection light and transmitted light;

the beam splitter has a first range of angle including transmittance depending on an angle of incoming light to be a predetermined transmittance, and a second range of angle including transmittance lower than that of the first range of angle;

the first range of angle is smaller than a predetermined angle of incidence, and the second range of angle is larger than the predetermined angle of incidence;

the object to be visibly recognized is provided on the upper side from the reels;

an image of the object to be visibly recognized illuminated by the illumination device is passed through the second range of angle toward the front of the reels upon the illumination device illuminating the object to be visibly recognized in response to the control signal;

the presentation effect device is positioned on an upper side of the gaming machine such that the player views the reflection light from the beam splitter at a second angle relative to the position of the player; and surfaces of the plurality of face panels are inclined in an upward direction such that the second angle is an upward angle relative to the first angle.

4. The gaming machine according to claim 3, wherein, upon lighting the illumination device in response to the control signal, light emitted from the illumination device is reflected in the inside of the accommodation body to illuminate the object to be visibly recognized, and light illuminated the object to be visibly recognized is transmitted toward the front of the reels through the second range of angle.

5. The gaming machine according to claim 3, wherein:

the plate-like panel has a front face panel arranged on a front side of the gaming machine.

* * * * *